US009410419B2

(12) United States Patent
Coles

(10) Patent No.: US 9,410,419 B2
(45) Date of Patent: Aug. 9, 2016

(54) DEVICE FOR MEASURING AND TRANSMITTING DOWNHOLE TENSION

(71) Applicant: Halliburton Energy Services, Inc., Houston, TX (US)

(72) Inventor: Randolph S. Coles, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 436 days.

(21) Appl. No.: 14/037,454

(22) Filed: Sep. 26, 2013

(65) Prior Publication Data

US 2015/0083408 A1 Mar. 26, 2015

(51) Int. Cl.

| | |
|---|---|
| ***E21B 47/12*** | (2012.01) |
| ***E21B 47/00*** | (2012.01) |
| ***E21B 49/00*** | (2006.01) |
| ***E21B 23/14*** | (2006.01) |
| ***E21B 23/03*** | (2006.01) |

(52) U.S. Cl.
CPC ..... *E21B 47/00* (2013.01); *E21B 23/14* (2013.01)

(58) Field of Classification Search
CPC ..... E21B 47/00
See application file for complete search history.

(56) References Cited

U.S. PATENT DOCUMENTS

| | | | | |
|---|---|---|---|---|
| 5,494,105 | A | 2/1996 | Morris | |
| 6,655,458 | B2 | 12/2003 | Kurkjian et al. | |
| 6,968,735 | B2 | 11/2005 | Ziolkowski et al. | |
| 7,081,831 | B2 * | 7/2006 | Dodge | G01V 11/002 340/853.1 |
| 2009/0071645 | A1 | 3/2009 | Kenison et al. | |
| 2013/0138254 | A1 * | 5/2013 | Seals | E21B 23/08 700/282 |
| 2014/0202691 | A1 * | 7/2014 | Coles | E21B 47/04 166/255.1 |
| 2015/0027736 | A1 * | 1/2015 | Smaardyk | E21B 47/0006 166/381 |

OTHER PUBLICATIONS

Official Action for Canadian Patent Application No. 2829523 dated Feb. 26, 2015.

* cited by examiner

*Primary Examiner* — Jennifer Mehmood
*Assistant Examiner* — Pameshanand Mahase
(74) *Attorney, Agent, or Firm* — McDermott Will & Emery LLP; Scott Richardson

(57) ABSTRACT

A system is disclosed that includes a tool string including one or more perforating guns, a conveyance operably coupled to the tool string at a socket coupling location and configured to help convey the tool string downhole, a load-measuring device arranged on the tool string and including one or more tension sensors configured to measure tensile load on the conveyance, the load-measuring device further including communication equipment capable of transmitting one or more uphole signals, wherein the one or more uphole signals includes measurement signals corresponding to the tensile load, and a computer system locatable at or near the surface location and communicably coupled to the tool string, the computer system being configured to receive and process the one or more uphole signals and further configured to transmit one or more downhole signals to the tool string to operate the one or more perforating guns.

18 Claims, 2 Drawing Sheets

DEVICE FOR MEASURING AND TRANSMITTING DOWNHOLE TENSION

BACKGROUND

The present disclosure relates to downhole measurements and, more particularly, to measuring the tension on a conveyance line with a downhole device.

After drilling and completing a wellbore that traverses a hydrocarbon-bearing formation, a tool string may be deployed down the wellbore to perform further operations on the wellbore. The tool string may be deployed using any number of conventional deployment methods, such as wireline or slickline deployment. The tool string may include a number of downhole tools and may additionally include equipment for monitoring conditions downhole. One example of a post-completion downhole tool that may be used is a perforating assembly, used in preparation for fracking and/or production operations. Upon conveyance of the tool downhole, one or more perforating guns associated with the perforating assembly are triggered to perforate the walls of the casing and wellbore and allow extraction of hydrocarbons from surrounding subterranean formations.

A telemetry cartridge is typically also included in tool strings and configured to communicate downhole information to the well operator at the surface. A casing collar locator (CCL) may optionally be attached to the telemetry cartridge. The CCL proves useful by passively detecting casing collars as the tool string is deployed or retrieved from the wellbore, thus resulting in providing the well operator with real-time depth information for the tool string. However, the CCL may not have sufficient signal to work in all ranges of casing sizes. The telemetry cartridge may also include tension measurement sensors to measure tension on the conveyance line. This tension information is important to the well operator as the conveyance line is typically connected to the downhole tool via a socket designed to separate the conveyance from the tool string upon experiencing a predetermined tensile load. Thus, the tension information may help the well operator prevent an unintentional disconnect of the tool string from the conveyance.

Unfortunately, operation of certain downhole tools, such as perforating guns, create violent disturbances which can damage the telemetry equipment and require repair or replacement of such equipment. Due to the potential for damaging telemetry equipment while using perforating equipment downhole, the telemetry cartridge and its associated sensors are often omitted from the tool string, thus depriving the well operator of valuable downhole information.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole measurements and, more particularly, to measuring the tension on a conveyance line with a downhole device.

The disclosed embodiments provide systems and methods for monitoring and transmitting the measured tension of a conveyance line used in wellbore operations. A tension sensor and associated data communication equipment are combined into a single unit, thus no longer requiring independent telemetry equipment. Further, embodiments of the presently disclosed devices may be implemented with existing tool strings, which already include casing collar locators and other common downhole tools designed to withstand forces and conditions resulting from particular downhole operations. Due to containing fewer parts and electronics, the systems disclosed herein are more robust and well suited to withstand the violent disturbances that may occur downhole, for example, during perforation operations.

Figures 1, 4:
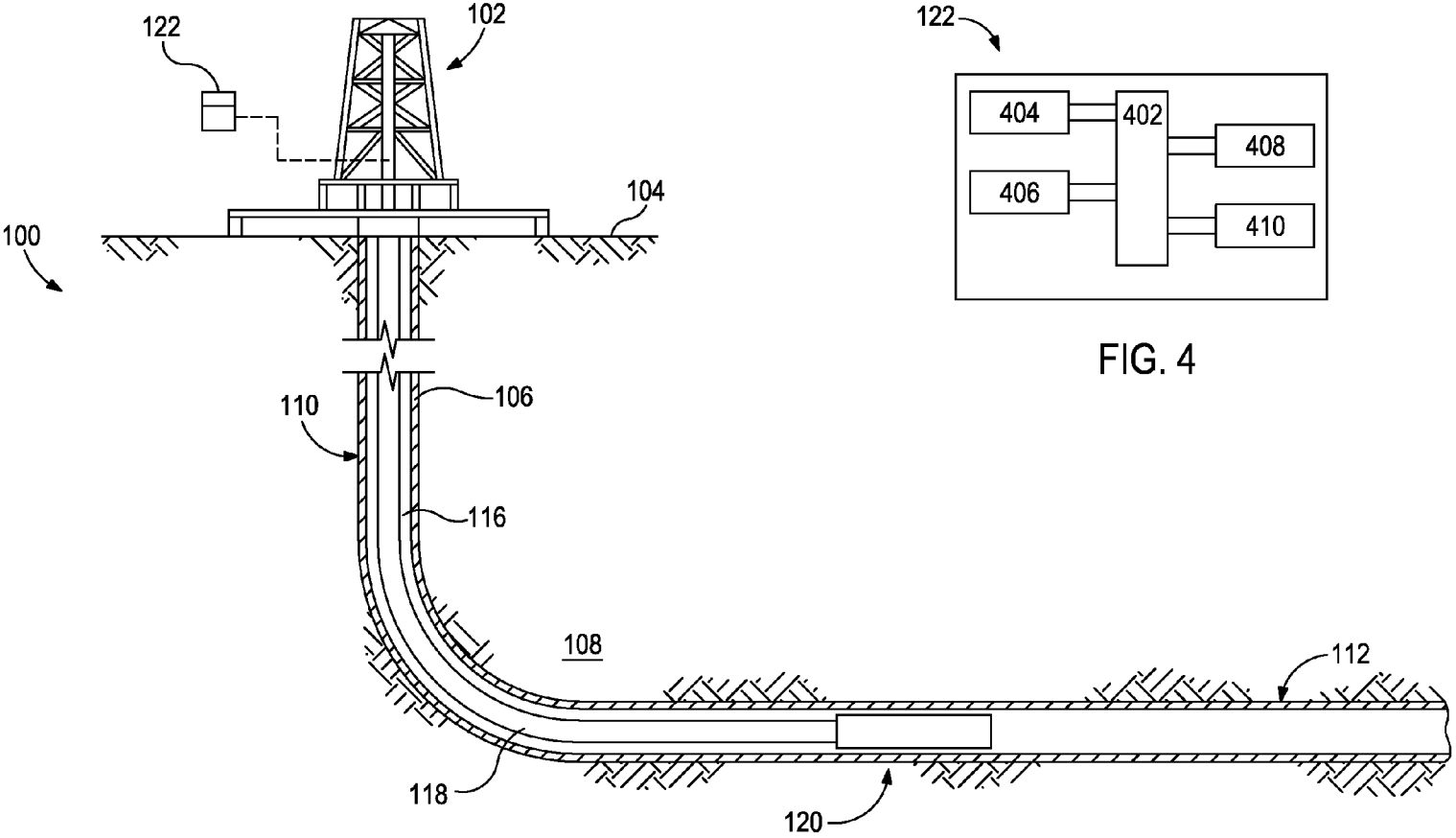
FIG. 1 is a well system that may embody or otherwise employ one or more principles of the present disclosure, according to one or more embodiments.
FIG. 4 depicts a computer system that may embody or otherwise employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation. Moreover, while the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 116 within the wellbore 106 along all or a portion thereof. As used herein, "casing string" may refer to any downhole tubular or string of tubulars known to those skilled in the art including, but not limited to, wellbore liner, production tubing, drill string, and other downhole piping systems.

The system 100 may further include a downhole tool string 120 conveyed into the wellbore 106. The downhole tool string 120 may be coupled or otherwise attached to a conveyance 118 that extends from the service rig 102. The conveyance 118 may be, but is not limited to, wireline, slickline, an electric line, coiled tubing, combinations thereof, and the like. In some embodiments, the tool string 120 may be pumped downhole to a target location within the wellbore 106 using hydraulic pressure applied from the service rig 102 at the surface 104. In other embodiments, the tool string 120 may be conveyed to the target location using gravitational or otherwise natural forces.

As will be described in greater detail below, the downhole tool string 120 may include measurement devices, and further include any number of downhole tools. In one embodiment, the sensors included in the downhole tool string 120 may be tension measurement sensors or casing collar locator sensors. In another embodiment, downhole tools included in the tool string 120 may include a wellbore perforating assembly located at or near the distal end of the tool string 120. In operation, the wellbore perforating assembly may be capable of perforating the casing string 116 and associated cement to allow fluid communication between the wellbore 106 and the formation 108.

The tool string 120 may be communicably coupled to a computer system 122 at the earth's surface 104 via conveyance 118. The computer system 122 can be located directly on the rig 102, or can be located anywhere on the earth's surface 104 near the rig 102. Further, the computer system 122 can be located off-site from the rig 102, wherein information may be sent to, and received by the computer system 122 via any method known to one of skill in the art, including wired or wireless communication methods. As described in more detail below with reference to FIG. 4, the computer system 122 may be any general computer system known to one of skill in the art capable of communicating (transmitting and receiving) data or signals with the downhole tool string 120. In one embodiment, the computer system 122 may allow a well operator to control the downhole tools included in the tool string 120 via hardware or software controls. The computer system 122 may further be capable of receiving signals or data sent from the tool string 120. The computer system 122 may also include processing capabilities to decode simultaneous signals that may be sent at varying frequencies, discussed in greater detail below. The computer system 122 can then output information received from the tool string 120 to the well operator (or any person at a remote location).

While FIG. 1 depicts the downhole tool string 120 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2:
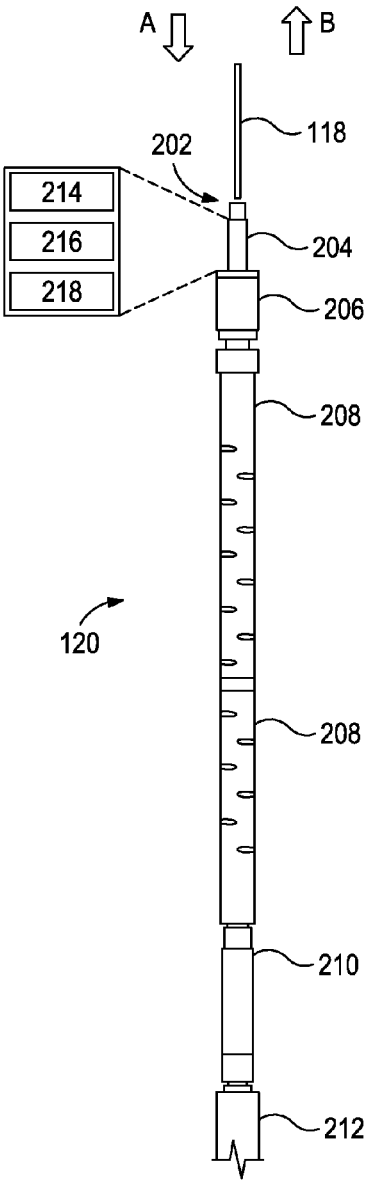
FIG. 2 is a tool string that may embody or otherwise employ one or more principles of the present disclosure, according to one or more embodiments.

Referring now to FIG. 2, with continued reference to FIG. 1, illustrated is an enlarged view of the exemplary tool string 120, according to one or more embodiments of the present disclosure. As illustrated, the tool string 120 may be operatively coupled or otherwise attached to the conveyance 118 at a socket coupling 202. In some embodiments, the tool string 120 may include a load-measuring device 204, a casing collar locator 206, one or more perforating guns 208 (two shown), and a lower sub 210. In at least one embodiment, the tool string 120 may further include a bridge plug setting tool 212.

As discussed above, the conveyance 118 may help convey the tool string 120 to a target location within the wellbore 106 (FIG. 1). The conveyance 118 may also be configured to facilitate communication between the tool string 120 and the computer system 122 (FIG. 1) located at the surface 104. Such communication may include information and data being sent in both directions A and B (e.g., uphole and downhole, respectively). More specifically, direction A represents information sent from the computer system 122 to the tool string 120 downhole. This may include signals to operate the downhole tools, for example, firing the perforating guns 208 or activating the bridge plug setting tool 212. In contrast, information sent in direction B may include information sent from the tool string 120 to the computer system 122. Such information may include measurement data from devices in the tool string 120, such as data relating to the detection of a casing collar from the casing collar locator 206 or tension information from the load-measuring device 204.

The tool string 120 may be coupled or otherwise attached to the conveyance 118 at the socket coupling 202 using any coupling device known in the art. In one embodiment, for example, the conveyance 118 may be operatively coupled to the tool string 120 using a socket or rope socket. The socket coupling 202 may be designed to separate or sever the conveyance 118 from the tool string 120 upon experiencing a predetermined load. This may prove advantageous in preventing the conveyance 118 from severing at an intermediate location between the surface 104 (FIG. 1) and the tool string 120, which would then require an expensive fishing operation to retrieve the severed portions of the conveyance 118 and the tool string 120. As such, the socket coupling 202 may be referred to as a "weak" point in the conveyance 118. To prevent unwanted disconnection of the conveyance 118 from the tool string 120, the tension between the conveyance 118 and tool string 120 may be measured in real-time using load-measuring device 204 and reported to the surface 104 for consideration by operators.

The load-measuring device 204 may be capable of performing multiple functions, including obtaining various downhole measurements and communicating with the computer system 122 (FIG. 1). In particular, as shown in the adjacent exploded view, the load-measuring device 204 may include one or more sensors 214, communication equipment 216, and filter circuitry 218. Moreover, the load-measuring device 204 may implement a pressure compensation system configured to protect the instruments and equipment arranged therein by means other than a mechanism that equalizes internal and external pressures, as such a mechanism would likely fail under the pressures incurred during perforation operations.

The one or more sensors 214 may be configured to measure tensile loads on the conveyance line 118 at or near the socket coupling 202. To accomplish this, the one or more sensors 214 may encompass any sensor known to one of skill in the art capable of measuring tension. Examples of such include, but are not limited to, load cells or strain gauges (e.g., piezoelectric, piezoresistive, fiber optic, etc.). In one embodiment, a Wheatstone bridge (quarter, half, or full-bridge) configuration may be used. Notably, one of skill in the art will appreciate the robustness of this type of sensor and sensor configuration. Upon acquisition of a signal by the sensor(s) 214, sensor compensation may be performed on the acquired signal. In one embodiment, compensation may be performed downhole by the sensor(s) 214 or by other hardware or software capabilities of the load-measuring device 204. In another embodiment, compensation may be performed uphole by hardware or software associated with the computer system 122 (FIG. 1).

The communication equipment 216 may be capable of communicating with the computer system 122 at the earth's surface 104. The communication equipment 216 may include circuitry to receive or transmit data with the computer system 122 (FIG. 1) via the conveyance 118. The communication equipment 216 may be capable of transmitting signals directly acquired through the sensor(s) 214, such as the load cell or strain gauge sensors previously discussed. The communication equipment 216 may also be capable of transmitting signals acquired by other downhole tools or measurement devices within to the tool string 120, such as the casing collar locator (CCL) 206. In one embodiment, the communications equipment 216 may implement data transmission of these signals to the computer system 122 by sending each signal individually on one or more transmission lines of the conveyance 118. In another embodiment, multiple signals may be sent by the communications equipment 216 to the computer system 122 simultaneously, where signals may be sent at varying frequencies. For example, a reading from the CCL 206 may be received by the load-measuring device 204, and then sent at a first frequency, while the load-measuring device 204 simultaneously sends data from the tension sensor 214 at a second frequency. As mentioned above, the computer system 122 (FIG. 1) will then decompose the signals to obtain individual sensor information.

The communication equipment 216 may also receive signals from the computer system 122 in direction A. These signals may be intended to reach downhole tools, thus, the load-measuring device 204 may act similar to a pass-through, receiving such signals from the computer system 122 and allowing them to propagate to their intended downhole tool or device. Examples of such signals may be arming and detonation signals for the perforating guns 208 or a control signal to operate the bridge plug setting tool 212.

The filter circuitry 218 may be configured to assist in preventing signal crosstalk between signals being sent in opposing directions A and B, and thereby preventing unwanted signals from reaching downhole tools. If such crosstalk were to occur and unintended signals ultimately reach the downhole tools, such as the perforating guns 208 and/or the bridge plug setting tool 212, this may cause unintentional operation of such downhole tools. In such cases, this may result in costly damage to the downhole tools, the tool string 120, and the wellbore 106 (FIG. 1). For example, if an unintended signal were to reach the perforating guns 208, this may cause premature detonation of the perforating guns 208 at an unintended depth, which would then require remedial operations to repair the wellbore 106. One of skill in the art will appreciate that, while implementing filters (e.g., the filter circuitry 219) to assist in preventing crosstalk, the filter circuitry 218 must still allow signals intended for downhole tools to propagate therethrough.

A person of skill in the art will readily appreciate the distinguishing features of the arrangement within the tool string 120. For instance, it may be desirable to measure tension on the conveyance 118 at or near the socket coupling 202 downhole, as opposed to measuring tension at the rig 102 or the earth's surface 104. This may be especially desirable when operating in a substantially horizontal wellbore portion 112 (FIG. 1), as surface measurements may be inaccurate due to portions of the conveyance 118 resting on the casing 116 when in the horizontal portion 112 of the wellbore 106.

Additionally, traditional telemetry devices are usually arranged below or otherwise incorporated with the CCL 206. According to the presently described embodiments, the telemetry device and the CCL 206 are arranged separately. For example, the load-measuring device 204 (including the communication equipment 216) is located closer to the proximal end of the tool string 120 than the CCL 206, and is independent of the CCL 206, thus enabling the load-measuring device 204 to be used with any current tool string. As a result, the load-measuring device 204 may also be used without requiring separate telemetry equipment.

Further, as described in the present disclosure, the simplicity and robustness of the load-measuring device 204 allows it to be used in conjunction with perforation operations and other violent downhole operations. In conventional systems, casing collar locators are usually designed similar to typical sensors, thus incapable of withstanding the pressures and forces that may be generated during perforation operations. Similarly, conventional telemetry cartridges and their associated sensors may use pressure compensation systems that equalize internal and external pressures, which likely fail when experiencing dramatic pressure differentials during perforation operations and thus are often omitted from the tool. However, as presently described, the CCL 206 is specially designed to withstand the conditions that occur during perforation operations. Additionally, the load-measuring device 204 implements a pressure compensation system which protects instruments and equipment therein by means other than a mechanism equalizing internal and external pressures. Therefore, the load-measuring device 204 itself may use fewer and more sturdy components, thus being more robust with less chance of communication failure during violent downhole operations. As such, the present disclosure enables use of tension monitoring equipment with tools having a violent nature.

The CCL 206 may be used for depth correlation of the tool string 120 and is designed for use in violent downhole operations (e.g., perforating operations). As the CCL 206 passes by a casing joint, or collar, the difference in metal thickness across two magnets associated with the CCL 206 induces a current spike in a coil also associated with the CCL 206. The CCL 206 is typically a passive device or sensor and may be communicatively coupled to load-measuring device 204. In exemplary operation, the CCL 206 may be configured to convey its acquired signals to the load-measuring device 204 such that the load-measuring device 204 may transmit such signals to the computer system 122 (FIG. 1).

Similar to the CCL 206, the perforating guns 208 and the bridge plug setting tool 212 may also be communicatively coupled to the load-measuring device 204. Accordingly, the load-measuring device 204 may receive command signals from the computer system 122 and otherwise act as a pass-through such that the signals are able to reach the perforating guns 208 and the bridge plug setting tool 212.

Figure 3:
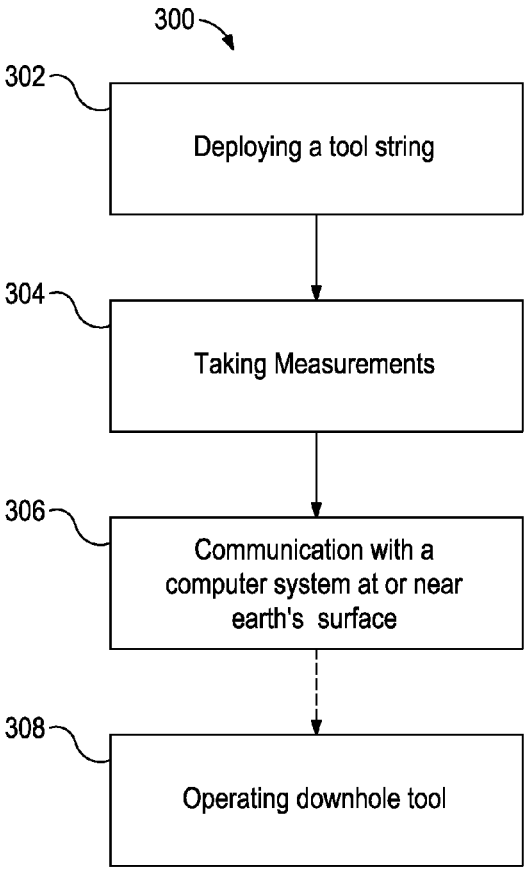
FIG. 3 depicts a flowchart illustrating a method embodying one or more principles of the present disclosure, according to one or more embodiments.

Referring now to FIG. 3, a schematic flowchart of a method 300 of measuring a load on a conveyance line is illustrated, according to one or more embodiments. According to the method 300, a tool string may be conveyed downhole, as at 302. As described herein, the tool string may be deployed using any number of conventional deployment methods, such as wireline or slickline deployment. The tool string may include various downhole tools and/or measurement devices, such as a load-measuring device, a casing collar locator, perforating guns used during fracking operations, and/or a bridge plug setting tool.

The tool string may be communicably coupled to a computer system at the earth's surface. More particularly, the load-measuring device of the tool string may include communication equipment capable of communicating with the computer system via the conveyance or via other telemetry methods and systems. The tool string and the computer system may both send and receive signals. In one embodiment, the downhole tool string may be configured to transmit measurements from one or more downhole sensors to the computer system. In another embodiment, command signals originating from the computer system may be conveyed to the tool string downhole and intended to operate the downhole tools as coupled to the tool string.

As at 304, various types of measurements may be acquired using the downhole measurement devices included in the tool string. In one embodiment, such measurement devices may include a casing collar locator that operates to detect casing collars, thus providing the well operator with real-time knowledge of the tool string current depth. In another embodiment, such measurement devices may include the load-measuring device, which may be configured to measure load (e.g., tension), communicate with the computer system at the surface, and/or filter signals (as discussed below). Acquisition of data from the load-measuring device measures strain on the conveyance. Because the coupling between the conveyance and the tool string may have a preset release tension, tension measurement information may be helpful to the well operator to assist preventing unintentional release between the conveyance and the downhole tool string.

After measurements have been taken, the data can be transmitted by the load-measuring device to the computer system located at or near the earth's surface via the conveyance line, as at 306. In one embodiment, signals may be individually transmitted to the computer system. In another embodiment, the load-measuring device may combine signals to send them simultaneously, but at varying frequencies. The uphole computer system would then decouple the received signals into individual sensor measurements.

The downhole tool string can also receive signals from the uphole computer system. Such signals may be intended to operate downhole tools, such as firing a perforating gun or operating a bridge plug setting tool, as at 308. To prevent crosstalk, the load-measuring device may implement filter circuitry. The filter circuitry may assist preventing crosstalk by allowing signals intended for downhole tools to pass through, but simultaneously preventing uphole signals from accidentally being communicated back downhole.

Referring now to FIG. 4, with reference again to FIG. 1, illustrated is an exploded view of the computer system 122, according to one or more embodiments. As illustrated, the computer system 122 may include components such as a bus 402, a controller 404, memory 406, a communications unit 408, and peripheral devices 410. Computer programs or algorithms executed by computer system 122 may be implemented using software, hardware, or a combination of both. In some embodiments, the computer system 122 may be arranged at or near the service rig 102. In other embodiments, however, the computer system 122 may be remotely located.

The bus 402 may provide electrical conductivity and a communication pathway among the various components of the computer system 122. The controller 404 may be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable device that can perform calculations or other manipulations of information.

The memory 406 can be one or more machine-readable media. Machine-readable media may include storage integrated into a processing system, such as might be the case with an ASIC. Machine-readable media may also include storage external to a processing system, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device. In one aspect, a machine-readable medium is a non-transitory machine-readable medium, a machine-readable storage medium, or a non-transitory machine-readable storage medium. In one aspect, a computer-readable medium is a non-transitory computer-readable medium, a computer-readable storage medium, or a non-transitory computer-readable storage medium. Instructions may be executable, for example, by a client device or server or by a processing system of a client device or server. Instructions can be, for example, a computer program including code.

The communications unit 408 may be capable of communication, both sending and receiving signals, with the tool string 120 (FIG. 1) located downhole via the conveyance 118. Example signals that may be sent from communications unit 408 to the tool string 120 may include signals to operate downhole tools, such as firing a perforating gun or setting a bridge plug. Example signals that may be received by the communications unit 408 from the downhole tool string 120 may include sensor signals such as from a casing collar locator or a tension sensor. Further, should the computer system 122 be remote from the rig 102, the communications unit 408 may handle communications with any device acting as an intermediary (not shown) in between the computer system 122 and the tool string 120.

Additionally, the computer system 122 may include one or more peripheral devices 410. The peripheral devices 410 may include, but are not limited to, a monitor (e.g., displays, GUIs, etc.), user input devices (e.g., keyboard, mouse, touchscreen, hardware or software controls, etc.), a printer, additional storage memory, etc. In one embodiment, peripheral devices 410 may be a touchscreen panel configured to both inform a well operator as to downhole conditions and signals, and allow the well operator to send signals to downhole tools.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A system, comprising:

a tool string including one or more downhole tools, wherein the one or more downhole tools includes one or more perforating guns;

a conveyance operably coupled to the tool string at a socket coupling and extendable from a surface location;

a load-measuring device arranged on the tool string and including one or more tension sensors configured to measure tensile load on the conveyance, the load-measuring device further including communication equipment capable of transmitting one or more uphole signals, wherein the one or more uphole signals includes signals corresponding to the tensile load;

a computer system locatable at or near the surface location and communicably coupled to the tool string, the computer system being configured to receive and process the one or more uphole signals and transmit one or more downhole signals to the tool string to operate the one or more perforating guns; and filter circuitry included in the load-measuring device to prevent crosstalk between the one or more uphole signals and the one or more downhole signals.

2. The system of claim 1, wherein the conveyance is a wireline or slickline.

3. The system of claim 1, wherein the one or more tension sensors comprises a sensor selected from the group consisting of a piezoelectric sensor, piezoresistive sensor, a fiber optic sensor, and a load cell sensor.

4. The system of claim 1, wherein the one or more tension sensors includes a Wheatstone bridge configuration.

5. The system of claim 1, wherein the one or more downhole signals comprises command signals configured to arm and detonate the one or more perforating guns.

6. The system of claim 1, wherein the tool string further includes a casing collar locator (CCL) arranged downhole from the load-measuring device on the tool string.

7. The system of claim 6, wherein the one or more uphole signals further comprises transmission of measurements derived from the CCL.

8. The system of claim 1, wherein the one or more uphole signals comprises a first uphole signal transmitted at a first frequency and a second uphole signal transmitted at a second frequency.

9. The system of claim 8, wherein the first uphole signal and the second uphole signal are transmitted simultaneously.

10. A method comprising:

deploying a tool string on a conveyance from a surface location, the tool string being operably coupled to the conveyance at a socket coupling and including one or more perforating guns;

measuring tensile load on the conveyance at the socket coupling with a load-measuring device included in the tool string, the load-measuring device including one or more tension sensors;

transmitting one or more uphole signals from the load-measuring device via the conveyance to a computer system locatable at or near the surface location, wherein the one or more uphole signals comprises measurements derived from the one or more tension sensors; and filtering the one or more uphole signals using filter circuitry within the load-measuring device.

11. The method of claim 10, wherein the conveyance is a wireline or slickline.

12. The method of claim 10, wherein the one or more tension sensors comprises a sensor selected from the group consisting of a piezoelectric, piezoresistive, fiber optic, and a load cell sensor.

13. The method of claim 10, wherein the one or more tension sensors includes a Wheatstone bridge configuration.

14. The method of claim 10, further comprising transmitting one or more downhole signals from the computer system to the one or more downhole tools, the one or more downhole signals being configured to arm and detonate the one or more perforating guns.

15. The method of claim 10, wherein transmitting the one or more uphole signals comprises transmitting measurements derived from a casing collar locator (CCL) included in the tool string.

16. The method of claim 10, wherein the transmitting the one or more uphole signals comprises transmitting a first uphole signal at a first frequency and a second uphole signal at a second frequency.

17. The method of claim 16, further comprising transmitting the first and second uphole signals simultaneously.

18. The method of claim 10, further comprising preventing crosstalk between the one or more uphole signals and the one or more downhole signals with the filter circuitry.

* * * * *